US008237528B2

(12) United States Patent
Nakatsuji

(10) Patent No.: US 8,237,528 B2
(45) Date of Patent: Aug. 7, 2012

(54) ELECTRONIC COMPONENT

(75) Inventor: Yoichi Nakatsuji, Kyoto-fu (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 13/207,053

(22) Filed: Aug. 10, 2011

(65) Prior Publication Data

US 2011/0291784 A1 Dec. 1, 2011

Related U.S. Application Data

(63) Continuation of application No. PCT/JP2009/071116, filed on Dec. 18, 2009.

(30) Foreign Application Priority Data

Feb. 10, 2009 (JP) ..... 2009-028690

(51) Int. Cl.
*H01F 27/02* (2006.01)

(52) U.S. Cl. ..... 336/83

(58) Field of Classification Search ..... 336/65, 336/83, 192, 200, 232
See application file for complete search history.

(56) References Cited

U.S. PATENT DOCUMENTS 3,812,442 A * 5/1974 Muckelroy ..... 336/83
6,218,925 B1 * 4/2001 Iwao ..... 336/200
6,304,164 B1 * 10/2001 Ohno et al. ..... 336/200
6,504,466 B1 * 1/2003 Katsurada ..... 336/200
6,630,881 B1 * 10/2003 Takeuchi et al. ..... 336/200
6,675,462 B1 * 1/2004 Takahashi ..... 29/602.1

FOREIGN PATENT DOCUMENTS

JP 06-029110 U 4/1994
JP 2000-353618 A 12/2000
JP 2009-260266 A 11/2009

OTHER PUBLICATIONS

International Search Report; PCT/JP2009/071116; Mar. 23, 2010.

* cited by examiner

*Primary Examiner* — Tuyen Nguyen
(74) *Attorney, Agent, or Firm* — Studebaker & Brackett PC; Tim L. Brackett, Jr.; John F. Guay

(57) ABSTRACT

An electronic component capable of adjusting the number of turns of a coil without preparing multiple kinds of inner conductors to be positioned at an end of the layer direction is composed of a multilayer body having multiple laminated magnetic layers. A spiral coil includes inner conductors and via-hole conductors connected to each other. Each of the inner conductors has a length of one turn. Both ends of each of the inner conductors are over points A and B. The inner conductor provided at the most negative side in the z-axis direction branches at one end so as to be over the points A and B.

6 Claims, 6 Drawing Sheets

PRIOR ART

ELECTRONIC COMPONENT

CROSS REFERENCE TO RELATED APPLICATIONS

The present application claims priority to Japanese Patent Application No. 2009-028690 filed Feb. 10, 2009, and International Patent Application No. PCT/JP2009/071116 filed Dec. 18, 2009, the entire contents of each of these applications being incorporated herein by reference in their entirety.

FIELD OF THE INVENTION

The present disclosure relates to electronic components and, more particularly, to an electronic component in which a coil is included in a multilayer body.

BACKGROUND

An example of a known multilayer inductor disclosed in Japanese Unexamined Patent Application Publication No. 2001-44037. FIG. 7 is an exploded perspective view of a multilayer body 111 of the multilayer inductor.

The multilayer body 111 includes magnetic layers 112*a* to 112*l*, inner conductors 114*a* to 114*f*, and via-hole conductors B1 to B5. The magnetic layers 112*a* to 112*l* are insulating layers that are disposed in the order from the upper side to the lower side in the layer direction.

The inner conductor 114*a* is provided on the magnetic layer 112*d* and one end of the inner conductor 114*a* extends to the right side face of the multilayer body 111. The inner conductors 114*b* to 114*e* make loops each having a length of one turn on the magnetic layers 112*e* to 112*h*, respectively. The inner conductors 114*b* and 114*d* have the same shape and the inner conductors 114*c* and 114*e* have the same shape. In other words, the inner conductors 114*b* and 114*d* and the inner conductors 114*c* and 114*e* having the two kinds of shapes are alternately arranged. The inner conductor 114*f* is provided on the magnetic layer 112*i* and one end of the inner conductor 114*f* extends to the left side face of the multilayer body 111.

The via-hole conductor B1 connects the inner conductor 114*a* with the inner conductor 114*b*, the via-hole conductor B2 connects the inner conductor 114*b* with the inner conductor 114*c*, the via-hole conductor B3 connects the inner conductor 114*c* with the inner conductor 114*d*, the via-hole conductor B4 connects the inner conductor 114*d* with the inner conductor 114*e*, and the via-hole conductor B5 connects the inner conductor 114*e* with the inner conductor 114*f*, thereby forming a coil L that spirally circles in the multilayer body 111. In the multilayer inductor in FIG. 7, a magnetic layer 112 having an inner conductor 114 provided thereon can be placed between, for example, the magnetic layer 112*h* and the magnetic layer 112*i* to adjust the number of turns of the spiral coil L in units of one turn.

However, according to the multilayer inductor described in Japanese Unexamined Patent Application Publication No. 2001-44037, it is necessary to change the shape of the inner conductor 114*f* in accordance with the shape of the inner conductor 114 placed between the magnetic layer 112*h* and the magnetic layer 112*i* in the multilayer inductor.

More specifically, the magnetic layer 112 having the inner conductor 114 of the same shape as that of the inner conductors 114*b* and 114*d* provided thereon may be placed between the magnetic layer 112*h* and the magnetic layer 112*i* in order to increase the number of turns of the spiral coil L by one turn in the multilayer body 111 in the state shown in FIG. 7.

However, since the shape of the inner conductors 114*b* and 114*d* is different from that of the inner conductor 114*e*, it is not possible to connect the inner conductor 114 having the same shape as that of the inner conductors 114*b* and 114*d* with the inner conductor 114*f* via a via-hole conductor. Accordingly, it is necessary to redesign the inner conductor 114*f* to have a shape allowing connection with the inner conductor 114 having the same shape as that of the inner conductors 114*b* and 114*d*.

In other words, it is necessary to prepare the inner conductors 114*f* having two kinds of shapes in order to adjust the number of turns of the spiral coil L in units of one turn in the multilayer inductor disclosed in Japanese Unexamined Patent Application Publication No. 2001-44037.

SUMMARY a. Embodiments of the present disclosure provide an electronic component capable of adjusting the number of turns of a coil without preparing multiple kinds of inner conductors to be positioned at an end of the layer direction.

b. In an exemplary embodiment of the present disclosure, an electronic component is a multilayer body including a plurality of insulating layers that are laminated; an outer electrode provided on a surface of the multilayer body; and a coil included in the multilayer body. The coil includes a first coil conductor that circles in a certain direction from a first point to a second point in a plan view from a layer direction; a second coil conductor that circles in the certain direction from the second point to the first point in a plan view from the layer direction; a first via-hole conductor connected to the first point of the first coil conductor; a second via-hole conductor connected to the second point of the second coil conductor; and an end conductor that is over the first point and the second point and that is electrically connected to the outer electrode in a plan view from the layer direction. The first coil conductor, the first via-hole conductor, the second coil conductor, and the second via-hole conductor are alternatively arranged in the layer direction in a state in which the first coil conductor, the first via-hole conductor, the second coil conductor, and the second via-hole conductor are electrically connected to each other. The end conductor is provided at an upper side or a lower side of the layer direction, compared with the first coil conductor and the second coil conductor, and is electrically connected to the adjacent first coil conductor or second coil conductor.

According to the embodiment of the present disclosure, it is possible to adjust the number of turns of a coil without preparing multiple kinds of inner conductors to be positioned at an end of the layer direction.

Other features, elements, characteristics and advantages of the present disclosure will become more apparent from the following detailed description of preferred embodiments of the present disclosure with reference to the attached drawings.

BRIEF DESCRIPTION OF DRAWINGS

FIG. 4(*b*) is a plan view of an inner conductor according to a second modification from the positive side in the z-axis direction.

A multilayer inductor, which is an electronic component according to an embodiment of the present disclosure, will now be described with reference to the drawings.

DETAILED DESCRIPTION

Structure of Multilayer Inductor

Figure 1:
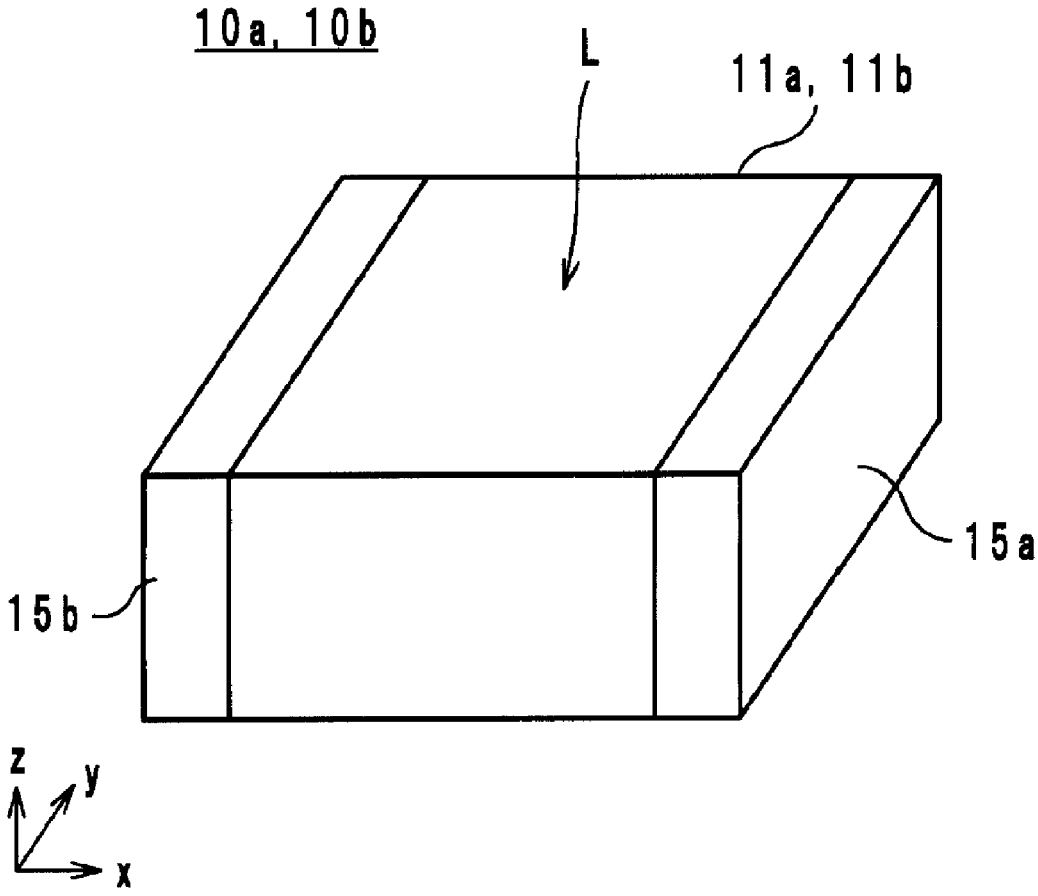
FIG. 1 is an external perspective view of a multilayer inductor.
Figure 2:
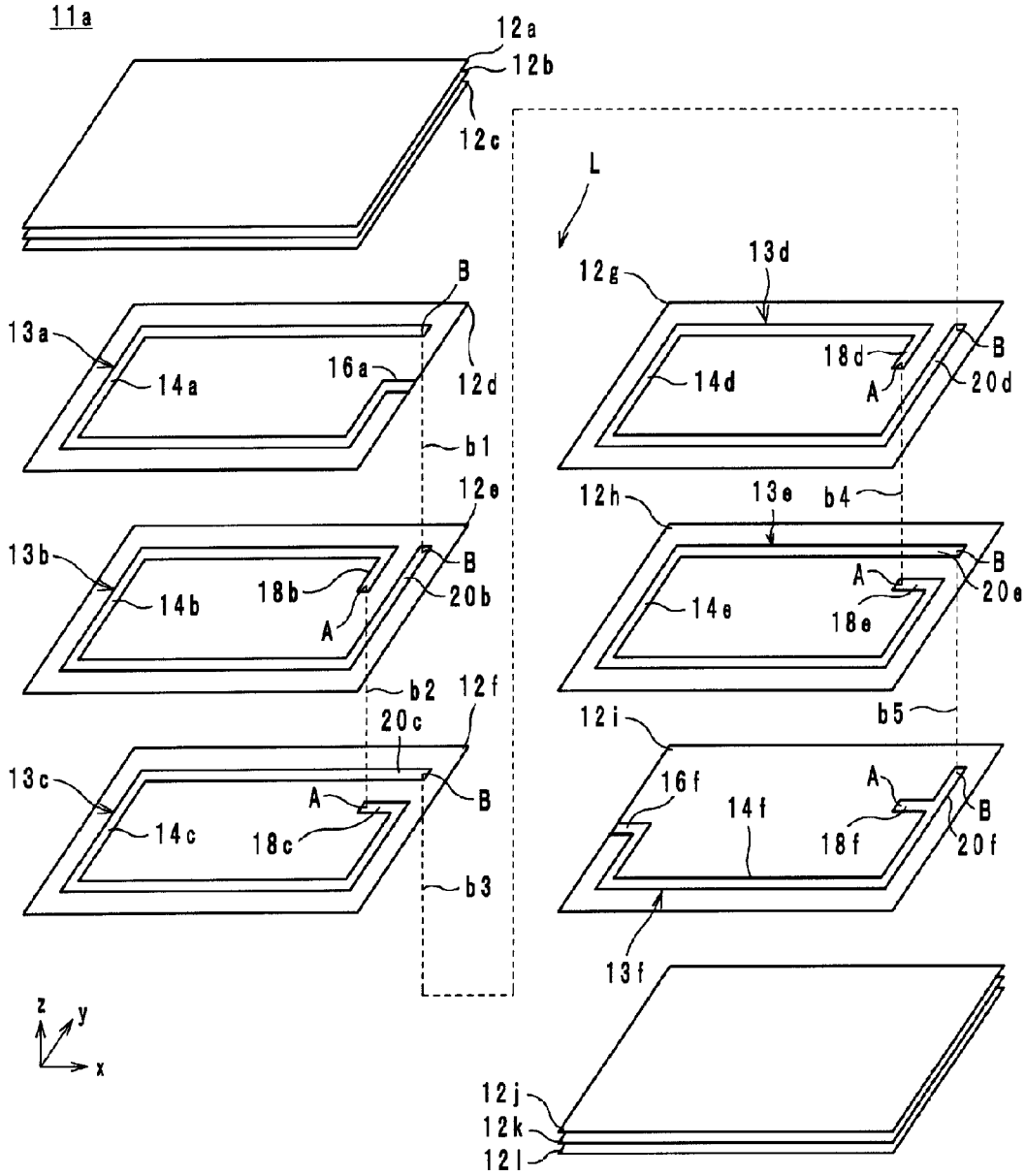
FIG. 2 is an exploded perspective view of a multilayer body of the multilayer inductor in FIG. 1.

FIG. 1 is an external perspective view of each of multilayer inductors 10*a* and 10*b*. FIG. 2 is an exploded perspective view of a multilayer body 11*a* of the multilayer inductor 10*a*. The layer direction of the multilayer inductor 10*a* is defined as the z-axis direction, the direction along the longer sides of the multilayer inductor 10*a* is defined as the x-axis direction, and the direction along the narrower sides of the multilayer inductor 10*a* is defined as the y-axis direction.

The multilayer inductor 10*a* includes the rectangular parallelepiped multilayer body 11*a* and two outer electrodes 15*a* and 15*b* formed on the side faces (surfaces) of the multilayer body 11*a*, which are positioned at both ends of the x-axis direction, as shown in FIG. 1.

The multilayer body 11*a* is formed by laminating magnetic layers 12*a* to 12*l* and includes a spiral coil L, as shown in FIG. 2. The magnetic layers 12*a* to 12*l* are multiple rectangular insulating layers made of magnetic ferrite (for example, Ni—Zn—Cu ferrite or Ni—Zn ferrite). Points A and B are defined on the magnetic layers 12*a* to 12*l*. Alphabet characters are appended to reference numerals when the magnetic layers 12*a* to 12*l* are individually specified, and the alphabet characters are omitted from the reference numerals when the magnetic layers 12*a* to 12*l* are collectively referred to hereinafter.

The spiral coil L includes inner conductors 13*a* to 13*f* and via-hole conductors b1 to b5. The inner conductors 13*a* to 13*f* are made of a conductive material mainly containing, for example, Ag. Alphabet characters are appended to the reference numerals when the inner conductors 13*a* to 13*f* are individually specified, and the alphabet characters are omitted from the reference numerals when the inner conductors 13*a* to 13*f* are collectively indicated hereinafter.

The inner conductors (coil conductors) 13*b* to 13*e* are coil conductors provided on the main faces at the positive side in the z-axis direction of the magnetic layers 12*e* to 12*h*, respectively. The inner conductors 13*b* to 13*e* are composed of coil parts 14*b* to 14*e* and connection parts 18*b* to 18*e* and 20*b* to 20*e*, respectively. The inner conductors 13*b* and 13*d* have the same shape and the inner conductors 13*c* and 13*e* have the same shape.

The coil parts 14*b* to 14*e* are linear electrodes each having a length of substantially one turn and a rectangular shape. The connection part 18*b* connects the point A on the magnetic layer 12*e* with one end of the coil part 14*b*. The connection part 18*c* connects the point A on the magnetic layer 12*f* with one end of the coil part 14*c*. The connection part 18*d* connects the point A on the magnetic layer 12*g* with one end of the coil part 14*d*. The connection part 18*e* connects the point A on the magnetic layer 12*h* with one end of the coil part 14*e*.

The connection part 20*b* connects the point B on the magnetic layer 12*e* with the other end of the coil part 14*b*. The connection part 20*c* connects the point B on the magnetic layer 12*f* with the other end of the coil part 14*c*. The connection part 20*d* connects the point B on the magnetic layer 12*g* with the other end of the coil part 14*d*. The connection part 20*e* connects the point B on the magnetic layer 12*h* with the other end of the coil part 14*e*.

Specifically, the connection parts 18*b* and 18*d* are connected to the downstream ends of the coil parts 14*b* and 14*d*, respectively, in the clockwise direction in a plan view from the positive side in the z-axis direction.

The connection parts 18*c* and 18*e* are connected to the upstream ends of the coil parts 14*c* and 14*e*, respectively, in the clockwise direction in a plan view from the positive side in the z-axis direction.

The connection parts 20*b* and 20*d* are connected to the upstream ends of the coil parts 14*b* and 14*d*, respectively, in the clockwise direction in a plan view from the positive side in the z-axis direction.

The connection parts 20*c* and 20*e* are connected to the downstream ends of the coil parts 14*c* and 14*e*, respectively, in the clockwise direction in a plan view from the positive side in the z-axis direction. Accordingly, the inner conductors 13*b* and 13*d* circle clockwise from the point B to the point A in a plan view from the positive side in the z-axis direction. The inner conductors 13*c* and 13*e* circle clockwise from the point A to the point B in a plan view from the positive side in the z-axis direction.

The inner conductor 13*a* is a linear conductor provided on the main face at the positive side in the z-axis direction of the magnetic layer 12*d*. The inner conductor 13*a* includes a coil part 14*a* and an extension 16*a*. The coil part 14*a* has a rectangular shape with a partial deficit in a plan view from the positive side in the z-axis direction and circles counterclockwise from the point B. The extension 16*a* is connected to the end of the coil part 14*a*, opposite to the point B, and extends to the side face toward the positive side in the x-axis direction of the multilayer body 11*a*. The inner conductor 13*a* is electrically connected to the outer electrode 15*a* with the extension 16*a*.

The inner conductor (end conductor) 13*f* is a linear conductor provided on the main face at the positive side in the z-axis direction of the magnetic layer 12*i*. The inner conductor 13*f* is over the points A and B in a plan view from the z-axis direction and is electrically connected to the outer electrode 15*b*.

More specifically, the inner conductor 13*f* includes a coil part 14*f*, an extension 16*f*, and connection parts 18*f* and 20*f*. The coil part 14*f* has a rectangular shape with a partial deficit in a plan view from the z-axis direction. The extension 16*f* is connected to one end of the coil part 14*f* and extends to the side face toward the negative side in the x-axis direction of the multilayer body 11*a*. Specifically, the extension 16*f* is connected to the downstream-side end in the clockwise direction of the coil part 14*f* in a plan view from the positive side in the z-axis direction. The inner conductor 13*f* is electrically connected to the outer electrode 15*b* with the extension 16*f*.

The connection part 18*f* connects the point A on the magnetic layer 12*i* with the other end of the coil part 14*f*, and the connection part 20*f* connects the point B on the magnetic layer 12*i* with the other end of the coil part 14*f*. Specifically, the connection parts 18*f* and 20*f* are connected to the upstream-side ends in the clockwise direction of the coil part 14*f* in a plan view from the positive side in the z-axis direction. The inner conductor 13*f* branches into two at the one end in the above manner and, thus, the inner conductor 13*f* is over the points A and B in a plan view from the z-axis direction.

The via-hole conductor b1 electrically connects the inner conductor 13*a* with the inner conductor 13*b*, the via-hole conductor b2 electrically connects the inner conductor 13*b* with the inner conductor 13*c*, the via-hole conductor b3 electrically connects the inner conductor 13*c* with the inner conductor 13*d*, the via-hole conductor b4 electrically connects the inner conductor 13*d* with the inner conductor 13*e*, and the via-hole conductor b5 electrically connects the inner conductor 13*e* with the inner conductor 13*f*, thereby constituting the spiral coil L.

The via-hole conductor b1 is provided so as to penetrate through the magnetic layer 12*d* having the inner conductor 13*a* provided thereon and is connected to the point B of the inner conductor 13*a*.

The via-hole conductor b2 is provided so as to penetrate through the magnetic layer 12*e* having the inner conductor 13*b* provided thereon and is connected to the point A of the inner conductor 13*b*.

The via-hole conductor b3 is provided so as to penetrate through the magnetic layer 12*f* having the inner conductor 13*c* provided thereon and is connected to the point B of the inner conductor 13*c*.

The via-hole conductor b4 is provided so as to penetrate through the magnetic layer 12*g* having the inner conductor 13*d* provided thereon and is connected to the point A of the inner conductor 13*d*.

The via-hole conductor b5 is provided so as to penetrate through the magnetic layer 12*h* having the inner conductor 13*e* provided thereon and is connected to the point B of the inner conductor 13*e*.

The inner conductors 13*b* and 13*d* and the via-hole conductors b2 and b4, and the inner conductors 13*c* and 13*e* and the via-hole conductors b3 and b5 are alternately arranged in the z-axis direction in a state in which the inner conductors 13*b* and 13*d* are electrically connected to the via-hole conductors b2 and b4, respectively. The inner conductors 13*c* and 13*e* are electrically connected to the via-hole conductors b3 and b5, respectively.

Specifically, the inner conductor 13*b* is connected with the inner conductor 13*c* at the point A via the via-hole conductor b2. The inner conductor 13*c* is connected with the inner conductor 13*d* at the point B via the via-hole conductor b3. The inner conductor 13*d* is connected with the inner conductor 13*e* at the point A via the via-hole conductor b4.

The inner conductor 13*a* is provided toward the positive side in the z-axis direction, compared with the inner conductors 13*b* to 13*d*. The inner conductor 13*a* is connected with the inner conductor 13*b* at the point B via the via-hole conductor b1.

The inner conductor 13*f* is provided toward the negative side in the z-axis direction, compared with the inner conductors 13*b* to 13*d*. The inner conductor 13*f* is connected with the inner conductor 13*e* at the point B via the via-hole conductor b5.

Method of Manufacturing Multilayer Inductor

A method of manufacturing the multilayer inductor 10*a* will now be described with reference to FIG. 1 and FIG. 2.

A raw material containing a certain amount of ferric oxide ($Fe_2O_3$), a certain amount of zinc oxide (ZnO), a certain amount of nickel oxide (NiO) and a certain amount of copper oxide (CuO) is subjected to wet mixing in a ball mill. After the resultant mixture is dried and milled, the resultant powder is calcined at 800° C. for one hour. The resultant calcined powder is subjected to wet milling in a ball mill, dried, and then disintegrated to produce a ferrite ceramic powder.

A binder (for example, vinyl acetate or water-soluble acryl), a plasticizer, a humectant and a dispersant are added to the ferrite ceramic powder to conduct mixing in a ball mill. The resultant mixture is defoamed by depressurization. The resultant ceramic slurry is formed into a sheet shape on a carrier sheet by a doctor blade method and is dried to produce a ceramic green sheet to be used as the magnetic layer 12.

Next, the via-hole conductors b1 to b5 are formed in the respective ceramic green sheets to be used as the magnetic layers 12*d* to 12*h*. Specifically, the ceramic green sheets to be used as the magnetic layers 12*d* to 12*h* are irradiated with laser beams to form via holes in the ceramic green sheets. The via holes are filled with a conductive paste made of Ag, Pd, Cu, Au or an alloy thereof by, for example, a printing method.

Then, a conductive paste mainly containing Ag, Pd, Cu, Au or an alloy thereof is applied to the ceramic green sheets to be used as the magnetic layers 12*d* to 12*i* by screen printing, photolithography or another method to form the inner conductors 13*a* to 13*f*. The formation of the inner conductors 13*a* to 13*f* and the filling of the via holes with the conductive paste may be performed in the same process.

Then, the ceramic green sheets are laminated. Specifically, the ceramic green sheet to be used as the magnetic layer 12*l* is disposed. The carrier film of the ceramic green sheet to be used as the magnetic layer 12*l* is peeled off and the ceramic green sheet to be used as the magnetic layer 12*k* is disposed. Then, the ceramic green sheet to be used as the magnetic layer 12*k* is subjected to pressure bonding to the magnetic layer 12*l*. The pressure bonding is performed under conditions in which a pressure of 100 tons to 120 tons be applied for about three seconds to thirty seconds. The carrier film is suction-discharged or chuck-discharged. Then, the ceramic green sheets to be used as the magnetic layers 12*j*, 12*i*, 12*h*, 12*g*, 12*f*, 12*e*, 12*d*, 12*c*, 12*b* and 12*a* are similarly laminated in this order and are subjected to the pressure bonding. As a result, a mother multilayer body is formed. Permanent pressure bonding is conducted on the mother multilayer body by using, for example, hydrostatic pressure.

Then, the mother multilayer body is cut into the multilayer body 11*a* of a certain size by guillotine cut to produce the multilayer body 11*a* that is not fired. A debinding process and firing are conducted on the unfired multilayer body 11*a*. The debinding process is conducted, for example, at a temperature of 500° C. for two hours in a low-oxygen atmosphere. The firing is conducted, for example, at a temperature of 800° C. to 900° C. for 2.5 hours.

The multilayer body 11*a* that is fired is produced by the above processes. The multilayer body 11*a* is subjected to barrel finishing and chamfering. Then, an electrode paste mainly made of silver is applied to the surface of the multilayer body 11*a* by, for example, an immersion method and is fired to produce silver electrodes to be used as the outer electrodes 15*a* and 15*b*. The firing of the silver electrodes is conducted at a temperature of 800° C. for one hour.

Finally, the surfaces of the silver electrodes are plated with nickel (Ni)/tin (Sn) to produce the external electrodes 15*a* and 15*b*. The multilayer inductor 10*a* shown in FIG. 1 is completed through the processes described above.

Although the multilayer inductor 10*a* is manufactured by the sequential pressure bonding, the multilayer inductor 10*a* may be manufactured by another method (for example, printing) other than the sequential pressure bonding.

Figure 3:
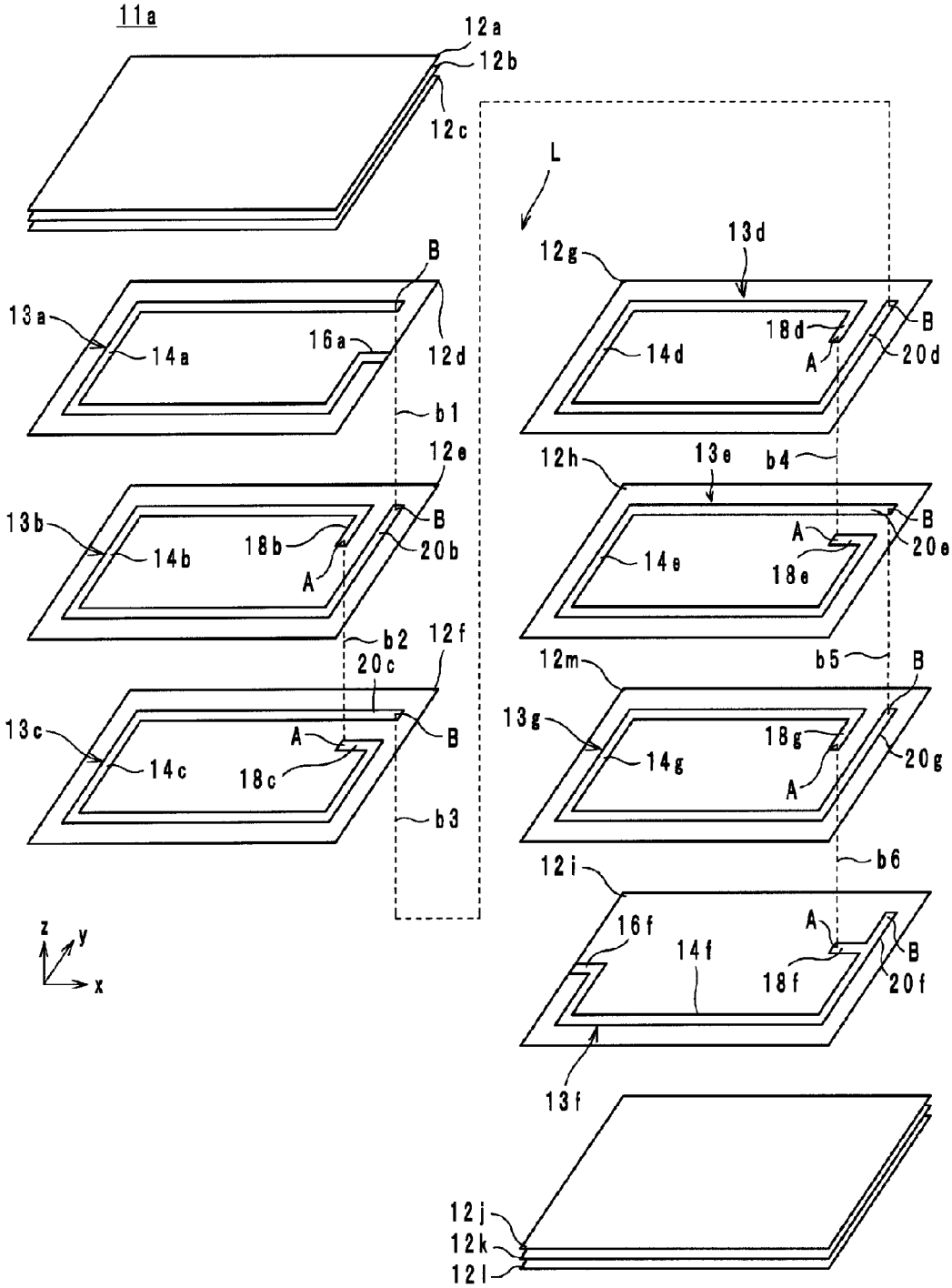
FIG. 3 is an exploded perspective view of the multilayer body of the multilayer inductor in FIG. 1.

In the multilayer inductor 10*a* having the above structure, the number of turns of the spiral coil L can be adjusted in units of one turn without preparing multiple kinds of the inner conductors 13*f* to be positioned at the negative-side end in the z-axis direction, as described below. FIG. 3 is an exploded perspective view of the multilayer body 11*a*. The number of turns of the spiral coil L in FIG. 3 is larger than that of the spiral coil L in FIG. 2 by one turn.

In order to increase the number of turns of the spiral coil L by one turn in the multilayer inductor 10*a* shown in FIG. 2, a magnetic layer 12*m* having an inner conductor 13*g* of the same shape as that of the inner conductors 13*b* and 13*d* provided thereon is placed between the magnetic layer 12*h* and the magnetic layer 12*i*, as shown in FIG. 3. In this case, the via-hole conductor b5 is connected to the point B of the inner conductor 13*g* to connect the inner conductor 13*e* with the inner conductor 13*g*. In contrast, the inner conductor 13*f* is over the points A and B in a plan view from the z-axis direction. Specifically, the inner conductor 13*f* has the connection parts 18*f* and 20*f* connecting the other ends of the coil part 14*f* with the points A and B, respectively. Accordingly, a via-hole conductor b6 provided in the magnetic layer 12*m* connects the point A of the inner conductor 13*g* with the point A of the inner conductor 13*f*.

With the above structure, in the multilayer inductor 10*a*, the inner conductor 13 adjacent to the inner conductor 13*f* can be connected with the inner conductor 13*f* even when the inner conductor 13 has the same shape as that of the inner conductors 13*b*, 13*d* and 13*g*, or even when the inner conductor 13 has the same shape as that of the inner conductors 13*c* and 13*e*. Consequently, according to the multilayer inductor 10*a*, it is possible to adjust the number of turns of the spiral coil L in units of one turn without preparing multiple kinds of the inner conductors 13*f* to be positioned at the negative-side end in the z-axis direction.

The connection parts 18*f* and 20*f* are linear electrodes in the multilayer inductor 10*a*, as shown in FIG. 2 and FIG. 3. Accordingly, the connection parts 18*f* and 20*f* also compose part of the spiral coil L. As a result, the number of turns of the spiral coil L is increased to increase the inductance of the spiral coil L in the multilayer inductor 10*a*.

Figure 4:
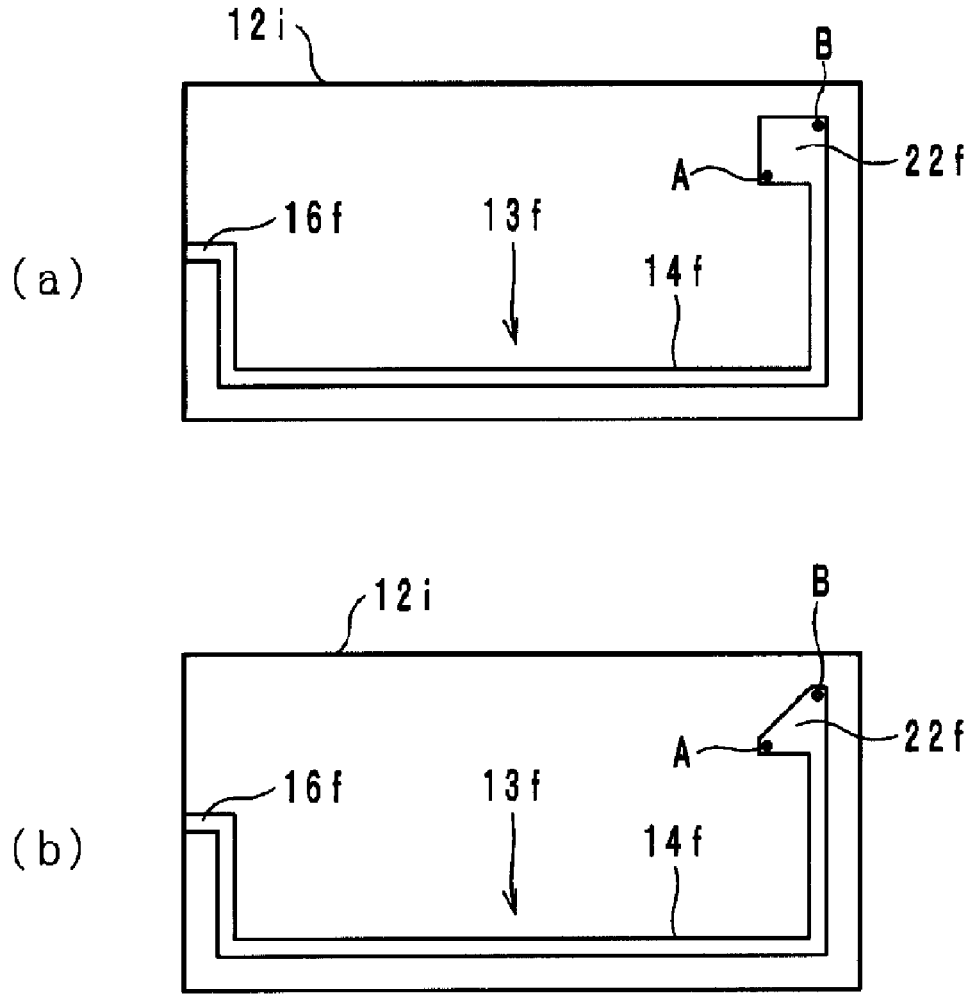
FIG. 4(*a*) is a plan view of an inner conductor according to a first modification from the positive side in the z-axis direction.

Modifications of the inner conductor 13*f* will now be described with reference to FIGS. 4(*a*) and (*b*). FIG. 4(*a*) is a plan view of the inner conductor 13*f* according to a first modification from the positive side in the z-axis direction. FIG. 4(*b*) is a plan view of the inner conductor 13*f* according to a second modification from the positive side in the z-axis direction.

It is sufficient for the inner conductor 13*f* to be over the points A and B in a plan view from the z-axis direction, as described above. Accordingly, the inner conductor 13*f* does not necessarily have the structure in which one end of the inner conductor 13*f* branches, as in the structure shown in FIG. 2 and FIG. 3. Specifically, the inner conductor 13*f* may have a quadrangular connection part 22*f* having the connection parts 18*f* and 20*f* as two sides, as shown in FIG. 4(*a*). Alternatively, the inner conductor 13*f* may have a right-angled triangular connection part 22*f* having the connection parts 18*f* and 20*f* as two sides, as shown in FIG. 4(*b*).

Figure 5:
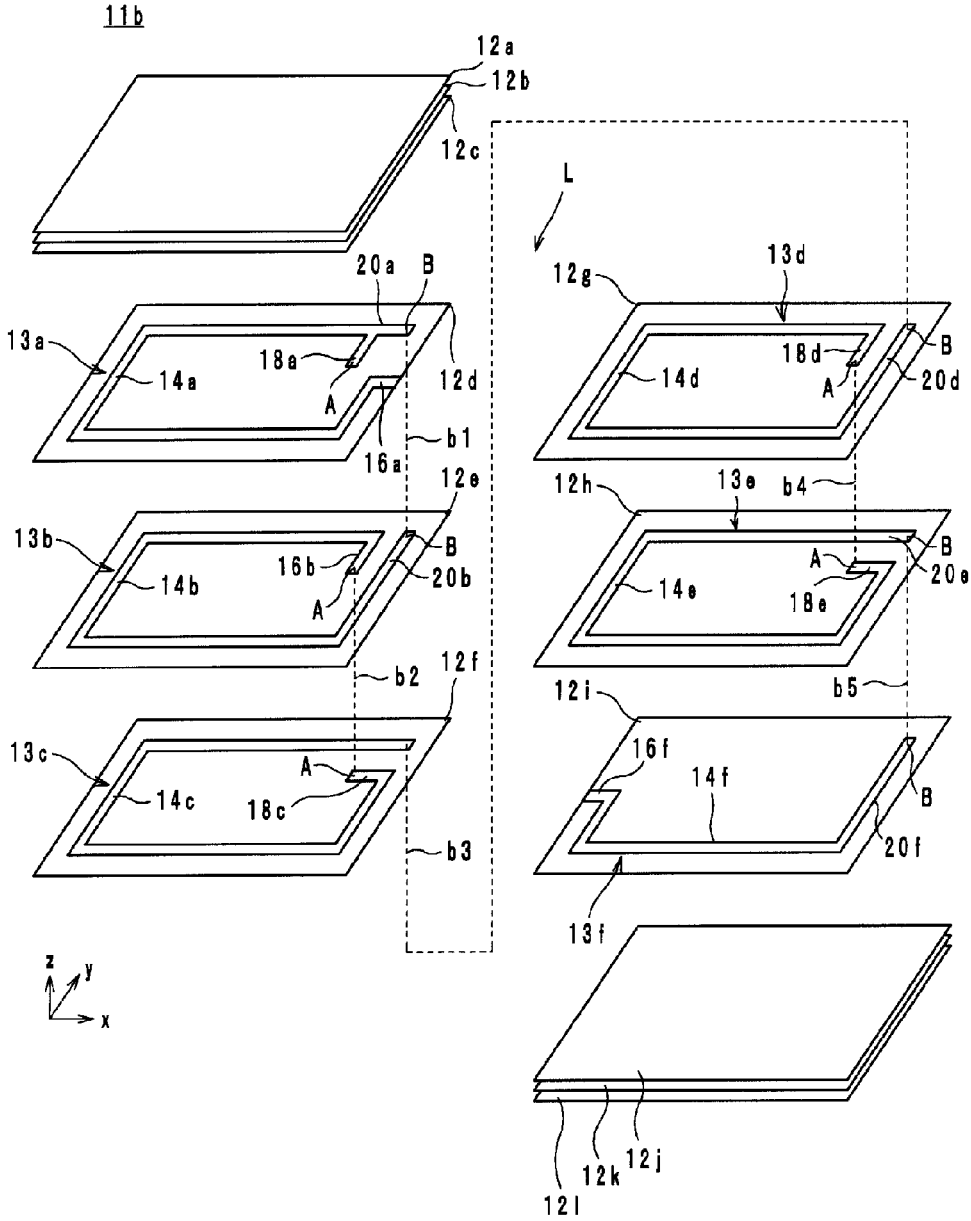
FIG. 5 is an exploded perspective view of a multilayer body of a multilayer inductor according to another embodiment.

The electronic component according to the present invention is not limited to the multilayer inductor 10*a* described in the above embodiments and various changes may be made to the invention without departing from the spirit thereof. The multilayer inductors 10*b* according to other embodiments will now be described with reference to the drawings. FIG. 5 is an exploded perspective view of a multilayer body 11*b* of the multilayer inductor 10*b*.

The number of turns of the spiral coil L is adjusted by adding the new inner conductor 13 between the inner conductor 13*f* positioned at the most negative side in the z-axis direction and the inner conductor 13*e* in the multilayer inductor 10*a*.

However, the method of adjusting the number of turns of the spiral coil L is not limited to the above. Specifically, the number of turns of the spiral coil L may be adjusted by adding the new inner conductor 13 between the inner conductor 13*a* positioned at the most positive side in the z-axis direction and the inner conductor 13*b*. However, it is necessary to differentiate the shape of the inner conductor 13*a* from the shape shown in FIG. 2 or FIG. 3 in order to realize such an adjusting method.

More specifically, the inner conductor 13 having the same shape as that of the inner conductors 13*b* and 13*d*, or the inner conductor 13 having the same shape as that of the inner conductor 13*c* and 13*e*, is adjacent to the inner conductor 13*a*. Accordingly, it is necessary for the inner conductor 13*a* to be structured so as to be capable of being connected to both the inner conductor 13 having the same shape as that of the inner conductors 13*b* and 13*d* and the inner conductor 13 having the same shape as that of the inner conductor 13*c* and 13*e*. Consequently, as shown in FIG. 5, it is sufficient for the inner conductor 13*a* to be over the points A and B in a plan view form the z-axis direction. However, in the multilayer inductor 10*b*, although it is not necessary to change the shape of the inner conductor 13*a* in accordance with the shape of the inner conductor 13 adjacent to the inner conductor 13*a*, it is necessary to change the position of the via-hole conductor b1. Specifically, the via-hole conductor b1 is provided at the point B when the inner conductor 13 adjacent to the inner conductor 13*a* has the same shape as that of the inner conductors 13*b* and 13*d*, while the via-hole conductor b1 is provided at the point A when the inner conductor 13 adjacent to the inner conductor 13*b* has the same shape as that of the inner conductors 13*c* and 13*e*.

Also in the multilayer inductor 10*b* having the above structure, the number of turns of the spiral coil L can be adjusted in units of one turn without preparing multiple kinds of the inner conductors 13*a* to be positioned at the positive-side end in the z-axis direction, as in the multilayer inductor 10*a*.

Figure 6:
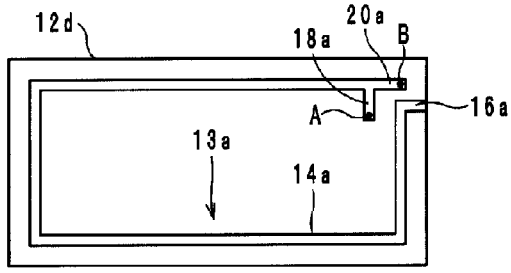
FIG. 6 is a plan view of an inner conductor according to a modification from the positive side in the z-axis direction.
Figure 7:
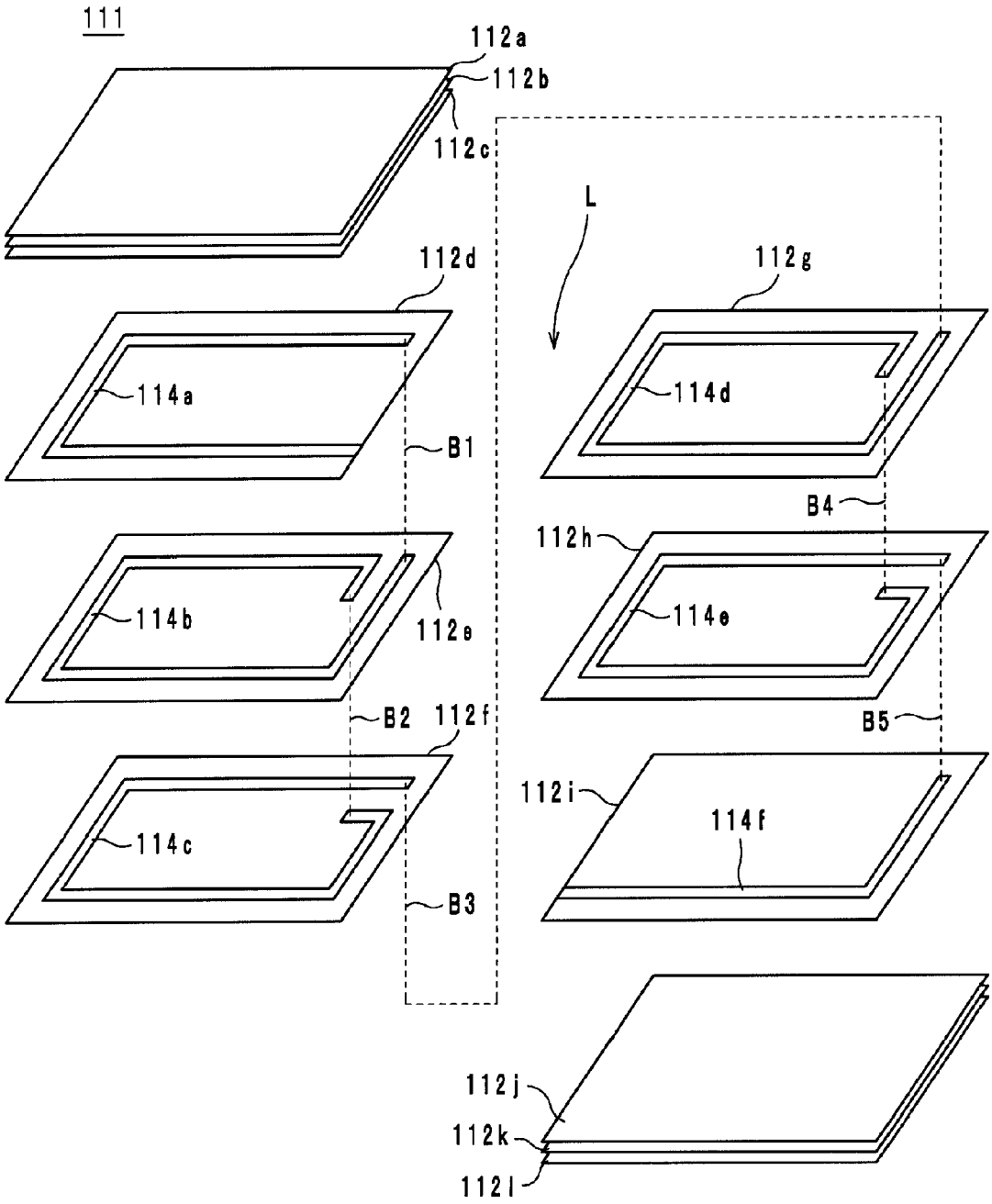
FIG. 7 is an exploded perspective view of a multilayer body of a multilayer inductor in related art.

The inner conductor 13*a* shown in FIG. 5 may be changed to the inner conductor 13*a* shown in FIG. 6. FIG. 6 is a plan view of the inner conductor 13*a* according to a modification from the positive side in the z-axis direction. The extension 16*a* shown in FIG. 6 is moved toward the positive side in the y-axis direction, compared with the extension 16*a* shown in FIG. 5, to enter in a quadrangular area having connection parts 18*a* and 20*a* as two sides. As a result, the length of the turn of the inner conductor 13*a* is increased to increase the inductance of the spiral coil L.

The spiral coil L is electrically connected to the outer electrodes 15*a* and 15*b* with the extensions 16*a* and 16*f* in the multilayer inductors 10*a* and 10*b*. However, the method of connecting the spiral coil L with the outer electrodes 15*a* and 15*b* is not limited to the above one. For example, when the outer electrodes 15*a* and 15*b* are provided on the top face and the bottom face at both ends in the z-axis direction of the multilayer body 11*a* or 11*b*, a via-hole conductor penetrating through the magnetic layers 12*a* to 12*c* and a via-hole conductor penetrating through the magnetic layers 12*i* to 12*l* may be provided, instead of the extensions 16*a* and 16*f* in FIG. 2. In this case, the via-hole conductors may connect the spiral coil L with the outer electrodes 15*a* and 15*b*.

Although the inner conductor 13 has a rectangular shape or a rectangular shape with a partial deficit in the multilayer inductors 10*a* and 10*b*, the shape of the inner conductor 13 is not limited to this. The inner conductor 13 may have, for example, a circular or elliptical shape or a circular or elliptical shape with a partial deficit.

The present invention is useful for an electronic component and, particularly, is excellent in that the number of turns of the coil can be adjusted without preparing multiple kinds of inner conductors to be positioned at an end in the layer direction.

While preferred embodiments of the disclosure have been described above, it is to be understood that variations and modifications will be apparent to those skilled in the art without departing from the scope and spirit of the disclosure.

What is claimed is:

1. An electronic component comprising:

a multilayer body including a plurality of laminated insulating layers;

an outer electrode provided on a surface of the multilayer body; and a coil formed in the multilayer body, wherein the coil includes:

a first coil conductor that circles in a first direction from a first point at a first end of the first coil conductor to a second point at a second end of the first coil conductor in a plan view from a layer direction;

a second coil conductor that circles in the first direction from the second point at a first end of the second coil conductor to the first point at a second end of the second coil conductor in the plan view from the layer direction;

a first via-hole conductor connected to the first coil conductor at the first point;

a second via-hole conductor connected to the second coil conductor at the second point; and an end conductor that overlaps the first point and the second point in the plan view from the layer direction and that is electrically connected to the outer electrode, wherein the first coil conductor, the first via-hole conductor, the second coil conductor and the second via-hole conductor are alternately arranged in the layer direction in a state in which the first coil conductor, the first via-hole conductor, the second coil conductor, and the second via-hole conductor are electrically connected to each other, and wherein the end conductor is provided at an upper side or a lower side of the layer direction, compared with the first coil conductor and the second coil conductor, and is electrically connected to the adjacent first coil conductor or second coil conductor.

2. The electronic component according to claim 1, wherein the first coil conductor, the second coil conductor, and the end conductor are provided on the main faces at the upper side in the layer direction of the corresponding insulating layers, wherein the first via-hole conductor is provided in the insulating layer on which the first coil conductor is provided, wherein the second via-hole conductor is provided in the insulating layer on which the second coil conductor is provided, and wherein the end conductor is provided at the lower side in the layer direction, compared with the first coil conductor and the second coil conductor.

3. The electronic component according to claim 1, wherein the end conductor branches into two at one end to overlap the first point and the second point in a plan view from the layer direction.

4. The electronic component according to claim 2, wherein the end conductor branches into two at one end to overlap the first point and the second point in a plan view from the layer direction.

5. The electronic component according to claim 1, wherein each of the first and second coil conductors form substantially an entire turn of the coil.

6. The electronic component according to claim 1, wherein the first and second points are positioned in a same quadrant of the multilayer body in the plan view from the layer direction.

* * * * *